United States Patent [19]

Cahannes et al.

[11] Patent Number: 4,462,312

[45] Date of Patent: Jul. 31, 1984

[54] SHATTERING AND INCENDIARY SHELL CONTAINING A PROJECTILE BODY

[75] Inventors: Paul Cahannes, Embrach; Eduard Daume, Richterswil; Jürg Sarbach, Jona, all of Switzerland

[73] Assignee: Werkzeugmaschinenfabrik Oerlikon-Bührle AG, Zürich, Switzerland

[21] Appl. No.: 384,180

[22] Filed: Jun. 2, 1982

[30] Foreign Application Priority Data

Jun. 24, 1982 [CH] Switzerland ..... 4184/82

[51] Int. Cl.[3] ..... F42B 13/14

[52] U.S. Cl. ..... 102/364; 102/473

[58] Field of Search ..... 102/364, 473, 491

[56] References Cited

U.S. PATENT DOCUMENTS 2,669,182 2/1954 Weiss ..... 102/364

2,824,515 2/1958 Loftin et al. ..... 102/364

4,237,787 12/1980 Wacula et al. ..... 102/364

FOREIGN PATENT DOCUMENTS 2034091 1/1972 Fed. Rep. of Germany .

1952494 8/1974 Fed. Rep. of Germany .

670998 9/1930 France .

1081806 12/1954 France .

2022789 12/1979 United Kingdom .

*Primary Examiner*—Charles T. Jordan

*Attorney, Agent, or Firm*—Werner W. Kleeman

[57] ABSTRACT

In order to improve the incendiary effect of munitions the hollow compartment of a projectile body of a shattering and incendiary shell or grenade is provided with an incendiary charge and two explosive charges. The incendiary charge possesses at its rear region or end a substantially funnel-shaped recess or cavity into which there protrudes a substantially conically-shaped tip of the first explosive charge of said two explosive charges.

4 Claims, 1 Drawing Figure

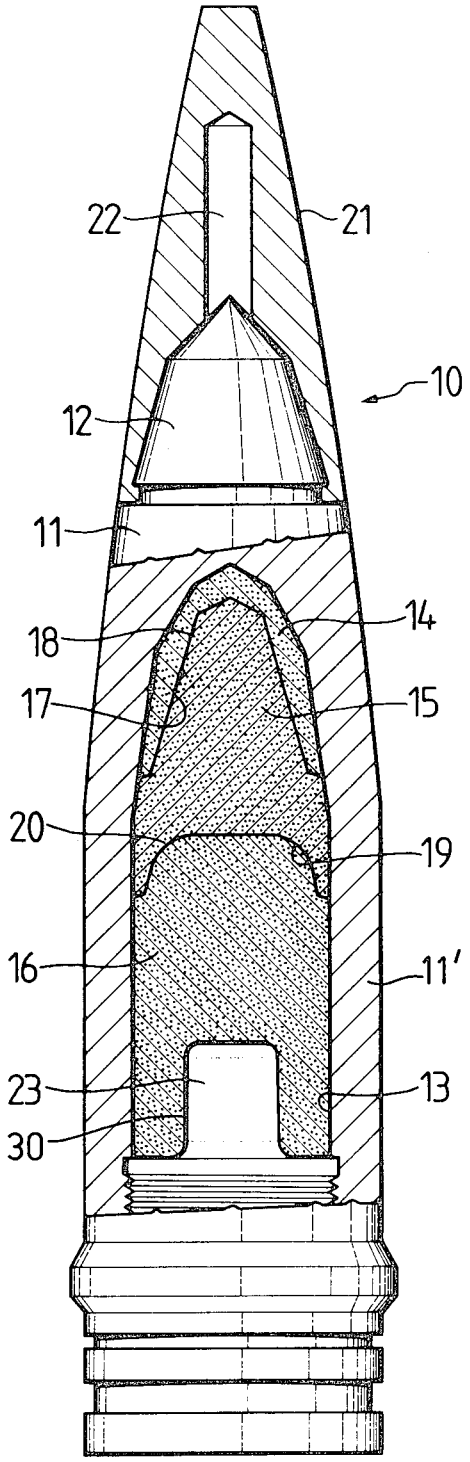
22
21
10
12
11
14
18
17
15
20
19
16
11'
23
13
30

SHATTERING AND INCENDIARY SHELL CONTAINING A PROJECTILE BODY

BACKGROUND OF THE INVENTION

The present invention relates to a new and improved construction of a shattering and incendiary shell containing a projectile body or projectile.

More specifically, the shattering and incendiary shell or grenade containing a projectile body, as contemplated by the present development, is of the type wherein a ballistic hood is arranged forwardly of the projectile body. Also, an explosive charge is arranged within the projectile body, and a highly-sensitive, delayed-action base fuze is arranged rearwardly of the explosive charge.

According to a state-of-the-art shattering and incendiary shell or grenade of the aforementioned type, as disclosed for instance in Swiss Pat. No. 542,424 and cognate German Patent Publication No. 2,034,091, a pyrotechnic composition or mass is arranged forwardly of the projectile body. The pyrotechnic composition is encapsulated by a ballistic hood. Behind the projectile body there is located a further pyrotechnic composition or mass, also designated as the shattering and incendiary mass, which first becomes effective following penetration of the shell or grenade at the armored target. At the tail portion of the projectile, behind the shattering and incendiary mass, there is arranged a highly-sensitive fuze which, however, responds with a time-delay, and which following the penetration of the armor penetration core at the target fragments the armor penetration core by means of an explosive charge, and at the target scatters such in conjunction with the shattering and incendiary mass.

The object which is intended to be solved with this prior art antitank incendiary projectile or grenade resides in designing the projectile such that, on the one hand, it can penetrate highly armored targets, first fully becoming effective after piercing the armoring, and, on the other hand, also positively responds even if there are hit weak structural elements or components. In any event the explosive incendiary mass should become fully effective following penetration of the projectile at the target.

According to a further known shattering and incendiary shell or grenade of the aforementioned type, as disclosed in the British Pat. No. 2,022,789, published Dec. 19, 1979, there is located at the forward region of the hollow compartment of the projectile body a pyrotechnic or incendiary charge and thereafter an explosive charge. Both of the charges are separated or bounded from one another by a flat surface. This arrangement is afflicted with the drawback that the incendiary charge is exclusively propelled forwardly by the explosive charge.

Other constructions of ammunition have been disclosed in U.S. Pat. No. 2,669,182, granted Feb. 16, 1954, U.S. Pat. No. 2,824,515, granted Feb. 25, 1958, French Pat. No. 1,081,806, published June 16, 1954, and French Pat. No. 670,998, published Mar. 3, 1930.

SUMMARY OF THE INVENTION

Therefore, with the foregoing in mind it is a primary object of the present invention to provide a new and improved construction of a shattering or fragmentation and incendiary shell which is not associated with the aforementioned drawbacks and limitations of the prior art constructions.

Another and more specific object of the present invention aims at providing a new and improved construction of a shattering and incendiary shell which affords an enlarged or proliferated incendiary effect of the incendiary charge located internally of the projectile body and allows outwardly propelling, as much as possible also laterally as possible, the incendiary charge.

Now in order to implement these and still further objects of the invention, which will become more readily apparent as the description proceeds, the incendiary or pyrotechnic charge is provided at its rear with a substantially funnel-shaped recess or cavity into which protrudes a substantially conical-shaped tip of the explosive charge.

One of the notable advantages of this construction and arrangement resides in the fact that, by virtue of the spraying of the incendiary or pyrotechnic charge with the aid of the explosive charge there is beneficially obtained a large spatial expanse or proliferation of the incendiary effect.

In the case of a projectile having a multiple effect, for instance as disclosed in the German Patent Publication No. 1,952,494, it is known to arrange internally of the projectile body an explosive charge behind an incendiary charge. However, this prior art projectile possesses neither a tip nor a base fuze, so that the effect of this projectile is not comparable with that of the inventive shattering and incendiary shell.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE of the drawing illustrates in longitudinal sectional view a shattering and incendiary shell or grenade constructed according to the invention.

DETAILED DESCRIPTION OF THE PREFERRED EMBODIMENTS

Directing attention now to the single FIGURE of the drawing, there is depicted therein a longitudinal sectional view through an exemplary embodiment of a shattering or fragmentation and incendiary shell or grenade 10 constructed according to the invention. As contemplated by the invention, this shattering and incendiary shell or grenade 10 possesses a projectile body or projectile 11 which is equipped with a tip 12 for penetrating a target. Additionally, the projectile body 11 has a hollow compartment or space 13 for accommodating an incendiary or pyrotechnic charge 14 and a bipartite or two-part explosive charge 15 and 16. The incendiary charge 14 possesses a substantially funnel-shaped recess or cavity 17 into which protrudes a substantially conical-shaped tip 18 of the first explosive charge 15. Equally, the first explosive charge 15 possesses a substantially bowl or shell-shaped recess 19 into which protrudes a domed projection or protuberance 20 of the second explosive charge 16. Behind the aforementioned three charges 14, 15 and 16, specifically the incendiary charge 14, the first explosive charge 15, and the second explosive charge 16, there is still available space for a highly-sensitive delayed-action base fuze 23, the construction of which is known as such, and, therefore, has not been here further illustrated to simplify the showing of the drawing, since the same does not constitute subject matter of the invention.

In the illustrated exemplary embodiment the shattering and incendiary shell or grenade 10 contains, for instance, five grams of a suitable incendiary or pyrotechnic composition or mass, especially zirconium for the incendiary charge 14, as well as 7.5 grams HEXAL P15 for the first explosive charge 15, and again 7.5 grams HEXAL P15 for the second explosive charge 16. HEXAL P15 is a trademark of an explosive available from Schweizer Sprengstoffabrik Dottikon, Dottikon, Switzerland, and comprises 4% of a binder like wax or plastic material, 30% of aluminum powder and 66% of cyclotrimethylenetrinitamine. By using a conically-shaped press punch it is possible to press the incendiary charge 14 into the hollow compartment 13 of the penetration core 11' of the projectile body 11 in such a manner that there is formed the aforementioned substantially funnel-shaped recess or cavity 17. The first explosive charge 15 is then partially pressed into the interior of the incendiary charge 14. By using a similar press punch it is possible to press or force the first explosive charge 15 into the hollow compartment 13 of the projectile body 11 in such a manner that there is formed the aforementioned substantially bowl or shell-shaped recess 19. The second explosive charge 16 is then partially pressed into the interior of the first explosive charge 15. By using a third press punch the second explosive charge 16 can be pressed or forced into the hollow compartment 13 of the projectile body 11 in such a manner that there is formed a recess 30 for receiving the aforementioned base fuze 23.

The tip 12 of the projectile body 11 is surrounded by a ballistic hood member or hood 21. This ballistic hood 21 possesses a substantially cylindrical hollow chamber 22 into which there can be inserted a not here particularly illustrated further incendiary or pyrotechnic charge.

Due to the combination of two explosive charges 15 and 16 in conjunction with an incendiary or pyrotechnic charge 14 the incendiary effect is enlarged, in particular there should be obtained a spatially expanded incendiary action. The particles of the incendiary composition or mass are sprayed throughout a large surrounding area by the explosive charge and the flames thus have imparted thereto a longer effective life.

While there are shown and described present preferred embodiments of the invention, it is to be distinctly understood that the invention is not limited thereto, but may be otherwise variously embodied and practiced within the scope of the following claims. Accordingly,

We claim:

1. A shattering and incendiary shell comprising:

a projectile body;

a ballistic hood arranged forwardly of said projectile body and coacting therewith;

explosive charge means arranged within said projectile body;

an incendiary charge;

said projectile body having a hollow compartment within which there is arranged said incendiary charge forwardly of said explosive charge means;

a highly-sensitive delayed-action base fuze arranged behind said explosive charge means;

said explosive charge means having an exclusively conically-shaped tip portion; and said incendiary charge having a rear portion containing an exclusively conically-shaped recess into which there protrudes said conically-shaped tip portion of said explosive charge means.

2. The shattering and incendiary shell as defined in claim 1, wherein:

said exclusively conically-shaped tip portion of said explosive charge means is arranged at a forward end of said explosive charge means.

3. The shattering and incendiary shell as defined in claim 1, wherein:

said incendiary charge only extends over a fraction of the total length of said explosive charge means.

4. A shattering and incendiary shell comprising:

a projectile body;

a ballistic hood arranged forwardly of said projectile body and coacting therewith;

explosive charge means arranged within said projectile body;

an incendiary charge;

said projectile body having a hollow compartment within which there is arranged said incendiary charge forwardly of said explosive charge means;

a highly-sensitive delayed-action base fuze arranged behind said explosive charge means;

said explosive charge means having a substantially conically-shaped tip portion;

said incendiary charge having a rear portion containing a substantially funnel-shaped recess into which there protrudes said conically-shaped tip portion of said explosive charge means;

said explosive charge means contains a first explosive charge and a second explosive charge;

said first explosive charge being provided with said conical-shaped tip portion which protrudes into the funnel-shaped recess;

said first explosive charge having a rear portion containing a substantially bowl-shaped recess; and said second explosive charge having a front portion containing a projection which is seated in said substantially bowl-shaped recess.

* * * * *